US008202821B2

(12) United States Patent
Natsui et al.

(10) Patent No.: US 8,202,821 B2
(45) Date of Patent: Jun. 19, 2012

(54) THERMAL RECORDING MATERIAL

(75) Inventors: Junpei Natsui, Tokyo (JP); Hiroshi Kohama, Tokyo (JP); Mamoru Suga, Tokyo (JP); Yoshimune Aosaki, Fukuoka (JP)

(73) Assignees: Nippon Paper Industries Co., Ltd, Tokyo (JP); API Corporation, Osaka (JP)

( * ) Notice: Subject to any disclaimer, the term of this patent is extended or adjusted under 35 U.S.C. 154(b) by 383 days.

(21) Appl. No.: 12/311,320

(22) PCT Filed: Sep. 26, 2007

(86) PCT No.: PCT/JP2007/068623

§ 371 (c)(1),
(2), (4) Date: May 19, 2009

(87) PCT Pub. No.: WO2008/038645

PCT Pub. Date: Apr. 3, 2008

(65) Prior Publication Data

US 2009/0280980 A1 Nov. 12, 2009

(30) Foreign Application Priority Data

Sep. 29, 2006 (JP) ..... 2006-269252

(51) Int. Cl.
*B41M 5/333* (2006.01)

(52) U.S. Cl. ..... 503/216; 503/209

(58) Field of Classification Search ..... None
See application file for complete search history.

(56) References Cited

U.S. PATENT DOCUMENTS

| | | | |
|---|---|---|---|
| 3,937,864 | A | 2/1976 | Kohmura et al. |
| 2004/0241598 | A1 | 12/2004 | Suga et al. |
| 2005/0118526 | A1 | 6/2005 | Suga et al. |

FOREIGN PATENT DOCUMENTS

| | | |
|---|---|---|
| JP | 49-45747 | 5/1974 |
| JP | 59-2891 | 1/1984 |
| JP | 63-13779 | 1/1988 |
| JP | 2002-326463 | 11/2002 |
| JP | 2002-326464 | 11/2002 |
| JP | 2002-332271 | 11/2002 |
| JP | 2005-125779 | 5/2005 |
| JP | 2007-210328 | 8/2007 |
| JP | 2007-245699 | 9/2007 |
| WO | 97/16420 | 5/1997 |
| WO | 00/14058 | 3/2000 |
| WO | 02/098674 | 12/2002 |
| WO | 03/029017 | 4/2003 |

OTHER PUBLICATIONS

International Search Report issued Nov. 13, 2007 in the International (PCT) Application of which the present application is the U.S. National Stage.

*Primary Examiner* — Bruce H Hess
(74) *Attorney, Agent, or Firm* — Wenderoth, Lind & Ponack, L.L.P.

(57) ABSTRACT

Provided is a thermal recording material superior in color development sensitivity, and having good preservation properties such as in heat resistance, moisture resistance, water resistance and the like.

A thermal recording material comprising a support and a thermal recording layer comprising a colorless or pale basic leucodye and a developer to develop color of the basic leucodye, wherein the aforementioned developer comprises a first developer which is a condensate or condensed composition represented by the following formula (I) and a second developer other than the first developer, and the proportion of the first developer to the total amount of the developers is not less than 2 wt % and less than 50 wt %:

(I)

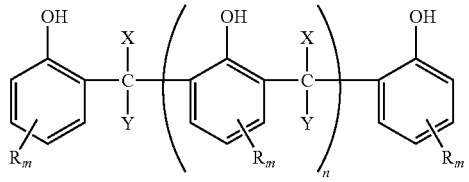

wherein R is a hydrogen atom, a halogen atom, a hydroxyl group, a lower alkyl group, an alkoxyl group, a cyano group, a nitro group, an aryl group or an aralkyl group, R in the number of m may be the same or different, m is an integer of 0 to 3, n is an integer of 0 to 3, and X and Y are each a hydrogen atom, an alkyl group or an aryl group.

9 Claims, No Drawings

THERMAL RECORDING MATERIAL

TECHNICAL FIELD

The present invention relates to a thermal recording material that provides recorded images utilizing a color development reaction between a colorless or pale basic leucodye and a developer due to heat.

BACKGROUND ART

In general, thermal recording materials that provide recorded images utilizing a color development reaction between a colorless or pale basic leucodye and a developer due to heat have been widely put to practical use for facsimile, computer field, various measurement equipments and the like, in view of advantages such as highly vivid color development, recording without noise, comparatively economical and compact apparatuses, easy maintenance and the like. In recent years, use as an output medium for various printers and plotters such as label, ticket, compact mobile terminal for outdoor measurement (handy terminal), carriage slip and the like has been growing rapidly. Particularly, use as an output medium for inspection of electricity, gas, tap water and the like, mobile printer (handy terminal) used for in-house sales (bullet train etc.), custody control in warehouses and the like is markedly increasing. Such mobile printers (handy terminals) have been downsized for easy portability, thus saving printing energy and driving energy. Along therewith, thermal recording materials are required to have high quality to meet higher color development sensitivity and printing adequacy comparable to that of general printing (offset lithography etc.). Moreover, since they are frequently used outside, preservation property to stand use in a harsh environment as compared to conventional ones, such as daylight, being left at midsummer high temperature inside a car, exposure to moisture such as rain etc., and the like is being required (i.e., resistance of a thermal recording material to heat, humidity, water and the like, which makes it possible to maintain density of the recorded images and suppress color development in non-image areas even when exposed to heat, humidity, water and the like).

To improve preservation property, for example, patent document 1 proposes addition of an antioxidant to a thermal recording layer together with a developer. However, the addition is not preferable since image quality such as color development sensitivity and the like is degraded. To improve preservation property, moreover, a developer having high preservation property such as ureaurethane compound disclosed in patent document 2 or patent document 3, phenolic compounds such as diaphenylsulfone crosslinking type compounds disclosed in patent document 4 and the like may be used alone. However, such developers having high preservation property are more expensive than general-purpose developers, and generally show low color development sensitivity even though the preservation property is improved to a certain level. As such, a thermal recording material having sufficiently satisfactory property for practical use in terms of color development sensitivity, preservation property (heat resistance, moisture resistance, water resistance etc.) and cost has not been obtained yet.

patent document 1: JP-A-59-2891
patent document 2: WO00/14058
patent document 3: JP-A-2002-332271
patent document 4: WO97/16420

DISCLOSURE OF THE INVENTION

Problems to be Solved by the Invention

In view of the above situation, the problem to be solved by the invention is to provide a thermal recording material having superior color development sensitivity and superior preservation property.

In addition, it is to provide a thermal recording material having the above-mentioned superior properties, and capable of keeping the cost low.

Means of Solving the Problems

The present inventors have conducted intensive studies in an attempt to solve the aforementioned problems and found that a thermal recording material having improved sensitivity and preservation properties (heat resistance, moisture resistance, water resistance) than conventional ones can be obtained by combining, as a developer, a condensate or condensed composition represented by the following formula (I) (the first developer) and a developer (the second developer) other than the condensate or condensed composition (the first developer), and setting the proportion of the condensate or condensed composition represented by the formula (I) (the first developer) relative to the total amount of the developers to a comparatively small, particular range, whereby enhancing the color developing action of the second developer, which resulted in the completion of the present invention. Accordingly, the present invention provides the following.

(1) A thermal recording material comprising a support and a thermal recording layer comprising a colorless or pale basic leucodye and a developer to develop color of the basic leucodye, wherein the aforementioned developer comprises a first developer which is a condensate or condensed composition represented by the following formula (I) and a second developer other than the first developer, and the proportion of the first developer to the total amount of the developers is not less than 2 wt % and less than 50 wt %:

(I)

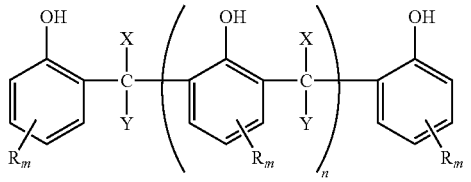

wherein R is a hydrogen atom, a halogen atom, a hydroxyl group, a lower alkyl group, an alkoxyl group, a cyano group, a nitro group, an aryl group or an aralkyl group, R in the number of m may be the same or different, m is an integer of 0 to 3, n is an integer of 0 to 3, and X and Y are each a hydrogen atom, an alkyl group or an aryl group.

(2) The thermal recording material of the above-mentioned (1), wherein the first developer is a condensed composition represented by the formula (I) mainly comprising a condensate of the formula (I) wherein n=0, and further comprising at least one kind of condensate selected from condensates of the formula (I) wherein n is 1-3.

(3) The thermal recording material of the above-mentioned (2), wherein the content of the condensate of the formula (I) wherein n=0 is 40-99%.

(4) The thermal recording material of any of the above-mentioned (1) to (3), wherein the second developer is at least one kind selected from bisphenol A, 4,4'-dihydroxydiphenylsulfone, 4-hydroxy-4'-n-propoxydiphenylsulfone, 2,4'-dihydroxydiphenylsulfone, 4-hydroxy-4'-allyloxydiphenylsulfone, and bis(3-allyl-4-hydroxyphenyl)sulfone.

Effect of the Invention

According to the present invention, a thermal recording material superior in the color development sensitivity and having good preservation property can be provided. IN addition, since an expensive developer having high preservation property is not used, such a thermal recording material having high property can be provided at a comparatively low cost.

BEST MODE FOR CARRYING OUT THE INVENTION

The present invention is described in more detail in the following.

The thermal recording material of the present invention is mainly characterized in that a combination of a developer which is a condensate or condensed composition represented by the above-mentioned formula (I) (first developer) and a developer (second developer) other than the developer (the first developer) is used as a developer to be contained in the thermal recording layer together with a basic dye, and that the proportion of the first developer to the total amount of the developers is set to fall within a comparatively small range.

In the formula (I), n is an integer of 0-3. In addition, m is an integer of 0-3, preferably 1-3, more preferably 1. When m is 2 or 3, R in the number of m may be the same or different. When m is 1-3, R is preferably bonded to the m-position or p-position of the hydroxyl group of a phenol group, and R is more preferably bonded to the p-position of the hydroxyl group of a phenol group.

In addition, R in the number of m are each a halogen atom, a hydroxyl group, an alkyl group having a carbon number of 1-5, an alkoxyl group having a carbon number of 1-5, a cyano group, a nitro group, an aryl group or an aralkyl group, preferably an alkyl group having a carbon number of 1-5 or an aralkyl group.

Examples of the halogen atom include chlorine atom, bromine atom and fluorine atom, with preference given to chlorine atom. Examples of the alkyl group having a carbon number of 1-5 include methyl, ethyl, n-propyl, isopropyl, t-butyl and t-amyl, with preference given to methyl, isopropyl and t-butyl. The alkoxyl group having a carbon number of 1-5 preferably has a carbon number of 1-4, and examples of the alkoxyl group having a carbon number of 1-4 include methoxy, ethoxy, n-propoxy, isopropoxy, n-butoxy and t-butoxy, with preference given to methoxy. Examples of the aryl group include phenyl, tolyl and naphthyl, with preference given to phenyl. Examples of the aralkyl group include cumyl and α-methylbenzyl.

In the formula, X and Y are each a hydrogen atom, an alkyl group or an aryl group. The alkyl group preferably has a carbon number of 1-5, particularly preferably 1-4, and methyl, ethyl, n-propyl, isopropyl, n-butyl, t-butyl and the like can be specifically mentioned. The aryl group is, for example, phenyl, tolyl, naphthyl and the like, with preference given to phenyl. Preferably, at least one of X and Y is a hydrogen atom, and more preferably, both are hydrogen atoms.

In the present invention, the "condensate or a condensed composition represented by the formula (I)", which is the first developer, is a condensate of the formula (I) wherein n is 0, 1, 2 or 3, or a composition of at least two kinds of such 4 kinds of condensates. Among these, a condensate wherein n=0 (2 core condensate), or a composition mainly comprising a condensate wherein n=0 (2 core condensate), and further, at least one kind of the condensates wherein n=1-3 (3-5 core condensates) is preferable. Particularly, a composition mainly comprising a condensate wherein n=0 (2 core condensate), and further, at least one kind of the condensates wherein n=1-3 (3-5 core condensates) is preferable. Here, "at least one kind of condensates wherein n=1-3 (3-5 core condensates)" means any one of a condensate wherein n=1 (3 core condensate) alone, two kinds of condensate wherein n=1 (3 core condensate) and a condensate wherein n=2 (4 core condensate), and three kinds of a condensate wherein n=1 (3 core condensate), a condensate wherein n=2 (4 core condensate) and a condensate wherein n=3 (5 core condensate), and "mainly comprising a condensate wherein n=0 (2 core condensate)" means that the proportion of a condensate wherein n=0 (2 core condensate) is highest among the condensates constituting the composition. In the present invention, moreover, the condensate or condensed composition represented by the following formula (I) may contain, when in use, a condensate of the formula (I) wherein n is not less than 4, which is an impurity, as long as the object of the present invention is not inhibited.

Examples of the condensate wherein n=0 (2 core condensate) include 2,2'-methylenebis(4-methylphenol), 2,2'-methylenebis(4-ethylphenol), 2,2'-methylenebis(4-isopropylphenol), 2,2'-methylenebis(4-t-butylphenol), 2,2'-methylenebis(4-n-propylphenol), 2,2'-methylenebis(4-n-butylphenol), 2,2'-methylenebis(4-t-amylphenol), 2,2'-methylenebis(4-cumylphenol), 2,2'-ethylidenebis(4-methylphenol), 2,2'-ethylidenebis(4-ethylphenol), 2,2'-ethylidenebis(4-n-propylphenol), 2,2'-ethylidenebis(4-isopropylphenol), 2,2'-ethylidenebis(4-t-butylphenol), 2,2'-ethylidenebis(4-n-butylphenol), 2,2'-ethylidenebis(4-t-amylphenol), 2,2'-ethylidenebis(4-cumylphenol), 2,2'-butylidenebis(4-methylphenol), 2,2'-butylidenebis(4-t-butylphenol) and the like. Of these, preferably is 2,2'-methylenebis(4-methylphenol), 2,2'-methylenebis(4-ethylphenol), 2,2'-methylenebis(4-isopropylphenol), 2,2'-methylenebis(4-t-butylphenol), 2,2'-methylenebis(4-n-butylphenol), 2,2'-methylenebis(4-n-propylphenol), 2,2'-methylenebis(4-t-amylphenol), 2,2'-methylenebis(4-cumylphenol), 2,2'-ethylidenebis(4-t-butylphenol), and 2,2'-butylidenebis(4-t-butylphenol).

Moreover, a specific example of the condensed composition [i.e., composition mainly comprising a condensate wherein n=0 (2 core condensate), and further, at least one kind of the condensates wherein n=1-3 (3-5 core condensates) is a composition mainly comprising the condensate described as a specific example of the above-mentioned 2 core condensate (a condensate wherein n=0), and further, a 3-5 condensate (condensate wherein n=1-3) corresponding thereto.

In this condensed composition, the content of a condensate wherein n=0 (2 core condensate) is preferably 40-99%, more preferably 45-98%, particularly preferably 50-80%. The "%" here means an "area %" in the results of high performance liquid chromatography analysis, and refers to the proportion of the area of a condensate wherein n=0 (2 core condensate) to the whole area of the condensates of the formula wherein n=0-3, which constitute the composition.

The condensate or condensed composition represented by the formula (I) can be produced, for example, by a known synthesis method comprising reacting substituted phenol represented by the following formula (II) and a ketone compound or an aldehyde compound represented by the following formula (III) in the presence of an acid catalyst (e.g., hydrochloric acid, p-toluenesulfonic acid etc.) and the like. The reaction is performed in a suitable organic solvent (e.g., water, methanol, ethanol, n-propyl alcohol, isopropyl alcohol, acetonitrile, toluene, chloroform, diethyl ether, N,N-dimethylacetamide, benzene, chlorobenzene, dichlorobenzenetetrahydrofuran etc.) capable of dissolving a starting material and a reaction product and inert to the reaction, at a reaction temperature of 0-150° C. for a few hours to several dozen hours. After the reaction, unreacted substituted phenol is distilled off to give the object condensate or condensed composition (solid) in a high yield. The thus-obtained object condensate or condensed composition may contain a condensate of the formula (I) wherein n is not less than 4, which is an impurity, as long as the effect of the first developer is not impaired. The thus-obtained condensate or condensed composition may be recrystallized from a suitable solvent to give the object condensate or condensed composition with a higher purity. A condensed composition comprising condensates with different substituents (R, X, Y in the formula) can be obtained by mixing reaction products (condensate or condensed composition) different from each other, which were produced in advance using starting compounds different from each other, or adding, to a reaction system for the synthesis of a particular condensate or condensed composition, a condensate or condensed composition having different substituent(s) from those of the particular condensate or condensed composition produced in advance.

(II)

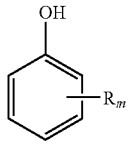

wherein R and m are as defined above.

(III)

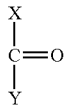

wherein X and Y are as defined above.

In the thermal recording material of the present invention, a combination of a developer which is a condensate or condensed composition represented by the above-mentioned formula (I) (first developer) and a developer (second developer) other than the first developer and capable of developing color of a basic leucodye is used as a developer to be contained in the thermal recording layer. It is important to use the first developer in a proportion comparatively small than the total amount of the developers (i.e., the total amount of the first developer and the second developer) in the thermal recording layer. Generally, the first developer is use in a proportion of not less than 2 wt % and less than 50 wt % of the total amount of the developers. When the amount of the first developer to the total amount of the developers is in this range, high color development sensitivity is obtained and the preservation property such as heat resistance, moisture resistance, water resistance and the like is improved. When the amount of the first developer to the total amount of the developers is less than 2 wt %, the preservation property improving effect becomes small, and when it is not less than 50 wt %, the preservation property rather decreases. The proportion of the first developer relative to the total amount of the developers is preferably 5-40 wt %, more preferably 5-25 wt %. Being in such preferable range, the preservation property improving effect becomes still higher.

In the present invention, other developer (the second developer) used in combination with the condensate or condensed composition represented by the formula (I) (the first developer) is not particularly limited as long as it is a known developer (excluding the developers explained in the Background Art, which have high preservation property) conventionally used in the field of pressure-sensitive or thermal recording papers. Specifically, for example, inorganic acidic substances such as active white clay, attapulgite, colloidal silica, aluminum silicate and the like; phenol series compounds such as 4,4'-isopropylidenediphenol, 1,1-bis(4-hydroxyphenyl)cyclohexane, 2,2-bis(4-hydroxyphenyl)-4-methylpentane, 4,4'-dihydroxydiphenylsulfide, hydroquinonemonobenzylether, 4-hydroxybenzyl benzoate, 4,4'-dihydroxydiphenylsulfone (aka: bisphenol S), 2,4'-dihydroxydiphenylsulfone, 4-hydroxy-4'-isopropoxydiphenylsulfone, 4-hydroxy-4'-n-propoxydiphenylsulfone, 4-hydroxy-4'-ethoxydiphenylsulfone, 4-hydroxybenzenesulfoneanilide, bis(3-allyl-4-hydroxyphenyl)sulfone, 4-hydroxy-4'-allyloxydiphenylsulfone, 4-hydroxy-4'-methyldiphenylsulfone, 4-hydroxyphenyl-4'-benzyloxyphenylsulfone, 3,4-dihydroxyphenyl-4'-methylphenylsulfone, bis(4-hydroxyphenylthioethoxy)methane, 1,5-di(4-hydroxyphenylthio)-3-oxapentane, bis(p-hydroxyphenyl)butyl acetate, bis(p-hydroxyphenyl)methyl acetate, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), diphenylsulfone crosslinking type compound described in WO97/16420 and the like; thiourea compounds such as 4,4'-bis(3-(phenoxycarbonylamino)methylphenylureido)diaphenylsulfone (manufactured by UU (trade name)), compounds described in WO02/081229, JP-A-2002-301873 and the like (manufactured by NIPPON SODA CO., LTD., D-100 (trade name)), compounds described in JP-B-3456792, JP-B-3612746 and the like, aminobenzenesulfonamide derivative described in JP-A-8-59603, N,N'-di-m-chlorophenylthiourea and the like; aromatic carboxylic acid series compounds such as p-chlorobenzoic acid, stearyl gallate, bis[4-(n-octyloxycarbonylamino)zinc salicylate]dihydrate, 4-[2-(p-methoxyphenoxy)ethyloxy]salicylic acid, 4-[3-(p-tolylsulfonyl)propyloxy]salicylic acid, 5-[p-(2-p-methoxyphenoxyethoxy)cumyl]salicylic acid and the like and salts of these aromatic carboxylic acid compounds with a polyvalent metal such as zinc, magnesium, aluminum, calcium, titanium, manganese, tin, nickel and the like; zinc thiocyanate antipyrine complex; composite zinc salt of terephthalaldehyde acid other aromatic carboxylic acid, and the like can be mentioned. These developers may be used alone or two or more kinds thereof may be combined.

Among these, phenolic compounds are preferable, and bisphenol A, 4,4'-dihydroxydiphenylsulfone (aka: bisphenol S), 4-hydroxy-4'-n-propoxydiphenylsulfone, 2,4'-dihydroxydiphenylsulfone, 4-hydroxy-4'-allyloxydiphenylsulfone, and bis(3-allyl-4-hydroxyphenyl)sulfone are particularly preferable.

In the thermal recording material of the present invention, the basic dye to be contained in the heat-coloring layer may be any colorless to pale basic dye known and used in the field of pressure sensitive or thermal recording paper material and is not particularly limited. Particularly, it is preferably a leucodye such as triphenylmethane, fluoran, fluorene, divinyl and the like. Specific examples of preferable basic dye are shown in the following. Any one kind of these basic dyes may be used alone or in a combination of two or more kinds thereof.

<Triphenylmethane Leucodye>

3,3-bis(p-dimethylaminophenyl)-6-dimethylaminophthalide [aka crystal violet lactone], 3,3-bis(p-dimethylaminophenyl)phthalide [aka malachite green lactone]

<Fluoran Leucodye>

3-diethylamino-6-methylfluoran,
3-diethylamino-6-methyl-7-anilinofluoran,
3-diethylamino-6-methyl-7-(o,p-dimethylanilino)fluoran,
3-diethylamino-6-methyl-7-chlorofluoran,
3-diethylamino-6-methyl-7-(m-trifluoromethylanilino)fluoran,
3-diethylamino-6-methyl-7-(o-chloroanilino)fluoran,
3-diethylamino-6-methyl-7-(p-chloroanilino)fluoran,
3-diethylamino-6-methyl-7-(o-fluoroanilino)fluoran,
3-diethylamino-6-methyl-7-(m-methylanilino)fluoran,
3-diethylamino-6-methyl-7-n-octylanilinofluoran,
3-diethylamino-6-methyl-7-n-octylaminofluoran,
3-diethylamino-6-methyl-7-benzylaminofluoran,
3-diethylamino-6-methyl-7-dibenzylaminofluoran,
3-diethylamino-6-chloro-7-methylfluoran,
3-diethylamino-6-chloro-7-anilinofluoran,
3-diethylamino-6-chloro-7-p-methylanilinofluoran,
3-diethylamino-6-ethoxyethyl-7-anilinofluoran,
3-diethylamino-7-methylfluoran,
3-diethylamino-7-chlorofluoran,
3-diethylamino-7-(m-trifluoromethylanilino)fluoran,
3-diethylamino-7-(o-chloroanilino)fluoran,
3-diethylamino-7-(p-chloroanilino)fluoran,
3-diethylamino-7-(o-fluoroanilino)fluoran,
3-diethylamino-benzo[a]fluoran,
3-diethylamino-benzo[c]fluoran,
3-dibutylamino-6-methyl-fluoran,
3-dibutylamino-6-methyl-7-anilinofluoran,
3-dibutylamino-6-methyl-7-(o,p-dimethylanilino)fluoran,
3-dibutylamino-6-methyl-7-(o-chloroanilino)fluoran,
3-dibutylamino-6-methyl-7-(p-chloroanilino)fluoran,
3-dibutylamino-6-methyl-7-(o-fluoroanilino)fluoran,
3-dibutylamino-6-methyl-7-(m-trifluoromethylanilino)fluoran,
3-dibutylamino-6-methyl-chlorofluoran,
3-dibutylamino-6-ethoxyethyl-7-anilinofluoran,
3-dibutylamino-6-chloro-7-anilinofluoran,
3-dibutylamino-6-methyl-7-p-methylanilinofluoran,
3-dibutylamino-7-(o-chloroanilino)fluoran,
3-dibutylamino-7-(o-fluoroanilino)fluoran,
3-di-n-pentylamino-6-methyl-7-anilinofluoran,
3-di-n-pentylamino-6-methyl-7-(p-chloroanilino)fluoran,
3-di-n-pentylamino-7-(m-trifluoromethylanilino)fluoran,
3-di-n-pentylamino-6-chloro-7-anilinofluoran,
3-di-n-pentylamino-7-(p-chloroanilino)fluoran,
3-pyrrolidino-6-methyl-7-anilinofluoran,
3-piperidino-6-methyl-7-anilinofluoran,
3-(N-methyl-N-propylamino)-6-methyl-7-anilinofluoran,
3-(N-methyl-N-cyclohexylamino)-6-methyl-7-anilinofluoran,
3-(N-ethyl-N-cyclohexylamino)-6-methyl-7-anilinofluoran,
3-(N-ethyl-N-cyclohexylamino)-6-methyl-7-(p-chloroanilino)fluoran,
3-(N-ethyl-p-toluideno)-6-methyl-7-anilinofluoran,
3-(N-ethyl-N-isoamylamino)-6-methyl-7-anilinofluoran,
3-(N-ethyl-N-isoamylamino)-6-chloro-7-anilinofluoran,
3-(N-ethyl-N-tetrahydrofurfurylamino)-6-methyl-7-anilinofluoran,
3-(N-ethyl-N-isobutylamino)-6-methyl-7-anilinofluoran,
3-(N-ethyl-N-ethoxypropylamino)-6-methyl-7-anilinofluoran,
3-cyclohexylamino-6-chlorofluoran,
2-(4-oxahexyl)-3-dimethylamino-6-methyl-7-anilinofluoran,
2-(4-oxahexyl)-3-diethylamino-6-methyl-7-anilinofluoran,
2-(4-oxahexyl)-3-dipropylamino-6-methyl-7-anilinofluoran,
2-methyl-6-p-(p-dimethylaminophenyl)aminoanilinofluoran,
2-methoxy-6-p-(p-dimethylaminophenyl)aminoanilinofluoran,
2-chloro-3-methyl-6-p-(p-phenylaminophenyl)aminoanilinofluoran,
2-chloro-6-p-(p-dimethylaminophenyl)aminoanilinofluoran,
2-nitro-6-p-(p-diethylaminophenyl)aminoanilinofluoran,
2-amino-6-p-(p-diethylaminophenyl)aminoanilinofluoran,
2-diethylamino-6-p-(p-diethylaminophenyl)aminoanilinofluoran,
2-phenyl-6-methyl-6-p-(p-phenylaminophenyl)aminoanilinofluoran,
2-benzyl-6-p-(p-phenylaminophenyl)aminoanilinofluoran,
2-hydroxy-6-p-(p-phenylaminophenyl)aminoanilinofluoran,
3-methyl-6-p-(p-dimethylaminophenyl)aminoanilinofluoran,
3-diethylamino-6-p-(p-diethylaminophenyl)aminoanilinofluoran,
3-diethylamino-6-p-(p-dibutylaminophenyl)aminoanilinofluoran,
2,4-dimethyl-6-[(4-dimethylamino)anilino]-fluoran, <Fluorine Leucodye>

3,6,6'-tris(dimethylamino)spiro[fluorene-9,3'-phthalide]
3,6,6'-tris(diethylamino)spiro[fluorene-9,3'-phthalide]

<Divinyl Leucodye>

3,3-bis-[2-(p-dimethylaminophenyl)-2-(p-methoxyphenyl)ethenyl]-4,5,6,7-tetrabromophthalide,
3,3-bis-[2-(p-dimethylaminophenyl)-2-(p-methoxyphenyl)ethenyl]-4,5,6,7-tetrachlorophthalide,
3,3-bis-[1,1-bis(4-pyrrolidinophenyl)ethylen-2-yl]-4,5,6,7-tetrabromophthalide,
3,3-bis-[1-(4-methoxyphenyl)-1-(4-pyrrolidinophenyl)ethylen-2-yl]-4,5,6,7-tetrachlorophthalide, <Other Basic Dyes>

3-(4-diethylamino-2-ethoxyphenyl)-3-(1-ethyl-2-methylindol-3-yl)-4-azaphthalide,
3-(4-diethylamino-2-ethoxyphenyl)-3-(1-octyl-2-methylindol-3-yl)-4-azaphthalide,
3-(4-cyclohexylethylamino-2-methoxyphenyl)-3-(1-ethyl-2-methylindol-3-yl)-4-azaphthalide,
3,3-bis(1-ethyl-2-methylindol-3-yl)phthalide,
3,6-bis(diethylamino)fluoran-γ-(3'-nitro)anilinolactam, 3,6-bis(diethylamino)fluoran-γ-(4'-nitro)anilinolactam, 1,1-bis-[2',2',2",2"-tetrakis-(p-dimethylaminophenyl)-ethenyl]-2,2-dinitrileethane,
1,1-bis-[2',2',2",2"-tetrakis-(p-dimethylaminophenyl)-ethenyl]-2-β-naphthoylethane,
1,1-bis-[2',2',2",2"-tetrakis-(p-dimethylaminophenyl)-ethenyl]-2,2-diacetylethane,
bis-[2,2,2',2'-tetrakis-(p-dimethylaminophenyl)-ethenyl]-methylmalonic acid dimethyl ester In thermal recording material of the present invention, the heat-coloring layer can be used a conventionally known sensitizer to the extent that the effect of the invention is not impaired or within the range where the effect of the invention can be enhanced. Examples of the sensitizer include, but are not limited to, ethylenebisamide, montanic acid wax, polyethylene wax, p-benzylbiphenyl, β-benzyloxynaphthalene, 4-biphenyl-p-tolylether, m-terphenyl, 4,4'-ethylenedioxy-bis-benzoic acid dibenzyl ester, dibenzoyloxymethane, bis[2-(4-methoxy-phenoxy)ethyl]ether, methyl p-nitrobenzoate, dibenzyl oxalate, di(p-chlorobenzyl) oxalate, di(p-methylbenzyl) oxalate, dibenzyl terephthalate, benzyl p-benzyloxybenzoate, di-p-tolyl carbonate, phenyl α-naphthylcarbonate, 1,4-diethoxynaphthalene, phenyl 1-hydroxy-2-naphthoate, 4-(m-methylphenoxymethyl)biphenyl, o-toluenesulfonamide, p-toluenesulfonamide, 1,2-diphenoxyethane, 1,2-di(3-methylphenoxy)ethane and the like. Any one kind of these sensitizers may be used alone or in a combination of two or more kinds thereof.

In the thermal recording material of the present invention, examples of the other components that can be added to the heat-coloring layer include pigment, binding agent (what is called a binder) and the like can be mentioned.

As the pigment, inorganic or organic fillers such as colloidal silica, silica, calcium carbonate, kaolin, fired kaolin, diatom earth, talc, titanium oxide, aluminum hydroxide, plastic pigment and the like, and the like can be mentioned. Among these, use of amorphous silica is preferable, since it improves color development density, and can prevent head chaff attachment and sticking. As such amorphous silica, one having an average particle size of not less than 5 μm is preferable, and one having an average particle size of 5-10 μm is more preferable. One showing oil absorption of not less than 150 ml/100 g is preferable, and one showing oil absorption of 150-400 ml/100 g is still more preferable. One having a specific surface area of 150 $m^2/g$ or below is preferable, and one having a specific surface area of 50-150 $m^2/g$ is more preferable. The "average particle size" here is measured by master sizer (D50% diameter). The "oil absorption" is measured according to JIS K5101. The "specific surface area" is measured according to BET THEORY. When the average particle size of amorphous silica is smaller than 5 μm, a sticking-preventive effect is not easily obtained, and when it is greater than 10 μm, the service life of the thermal head may become shorter, the strength of a coating layer of paper may become weaker, and image quality may be degraded. Moreover, when oil absorption is less than 150 ml/100 g, head chaff attachment or sticking-preventive effect is not easily obtained, and when the specific surface area is greater than 150 $m^2/g$, whiteness of the paint may decrease. Examples of preferable amorphous silica include CARPLEX101 (manufactured by Degussa Japan (trade name), Finesil P-8) and the like.

Calcium carbonate is preferably added together with amorphous silica, since head chaff or sticking-preventive effect is more easily obtained. Calcium carbonate has an average particle size of not less than 3 μm, preferably not more than 10 μm. The "average particle size" here is measured by master sizer (D50% diameter). Examples of calcium carbonate having an average particle size of not less than 3 μm include HAKUENKA PZ (cubic form calcium carbonate aggregate), PC/PCX (spindle form calcium carbonate), Cal-Light SA (aragonite form calcium carbonate), tuNEX E (spindle form calcium carbonate coagulate) and the like, manufactured by SHIRAISHI CALCIUM KAISHA, LTD. When amorphous silica and calcium carbonate are blended, the amount ratio (weight ratio) thereof is preferably about 1:10-10:1.

As the binder, those generally known can be used to improve flowability of the coating material and the like, as long as the desired effect of the present invention is not inhibited. Specific examples include completely hydrolyzed polyvinyl alcohol having a polymerization degree of 200-1900, partially hydrolyzed polyvinyl alcohol, carboxy denatured polyvinyl alcohol, amide-modified polyvinyl alcohol, sulfonic acid-modified polyvinyl alcohol, butyral-modified polyvinyl alcohol, other modified polyvinyl alcohols, cellulose derivatives such as hydroxyethyl cellulose, methyl cellulose, carboxymethyl cellulose, ethyl cellulose and acetylcellulose, styrene-maleic anhydride copolymer, styrene-butadiene copolymer, polyvinyl chloride, polyvinyl acetate, polyacrylamide, polyacrylic acid ester, polyvinylbutyral, polystyrene and their copolymers, polyamide resin, silicone resin, petroleum resin, terpene resin, ketone resin and cumarone resin. These polymer substances are dissolved in a solvent such as water, alcohol, ketone, ester, hydrocarbon and the like and then used, or used in the form of an emulsion or dispersion like a paste in water or other medium, and they may be combined to achieve a desired quality.

In addition, a stabilizer may be added as long as the effect of the invention is not inhibited, so as to impart recorded images with oil resistance and the like. Examples of the stabilizer include 4,4'-butylidene(6-t-butyl-3-methylphenol), 2,2'-di-t-butyl-5,5'-dimethyl-4,4'-sulfonyldiphenol, 1,1,3-tris(2-methyl-4-hydroxy-5-cyclohexylphenyl)butane, 1,1,3-tris(2-methyl-4-hydroxy-5-t-butylphenylbutane, 4-benzyloxy-4'-(2,3-epoxy-2-methylpropoxy)diphenylsulfone, epoxy resin and the like.

It is also possible to use, in addition to the stabilizer, lubricant such as wax and the like, benzophenone type or triazole type UV absorber, water resistant additive such as glyoxal and the like, dispersing agent, antifoaming agent, antioxidant, fluorescence dye and the like.

In the thermal recording material of the present invention, the kind and amount of basic leucodye, developer, and various other components (materials) are determined according to the desired property and recording adequacy, and is not particularly limited. Generally, a developer is used in an amount of about 0.5-10 parts by weight, preferably about 1-5 parts by weight, per 1 part by weight of a basic leucodye, a pigment is used in an amount of about 0.5-10 parts by weight per 1 part by weight of a basic leucodye, and a sensitizer is used in an amount of about 0.5-10 parts by weight per 1 part by weight of a basic leucodye. Other components can be used in suitable amounts without impairing the effect of the invention.

To obtain the thermal recording material of the present invention, for example, dispersion liquids of each of a dye, a developer, a sensitizer and the like are prepared together with a binder, other necessary additives such as filler and the like are added to and mixed with the dispersion liquids to give a coating liquid, which is applied on a substrate (support), and dried to form a thermal recording layer. As a solvent to be used for the coating liquid, water, alcohol and the like can be used. The solid content of the coating liquid is preferably about 15-40 wt %. The dispersion liquids of each component (material) are preferably subjected to wet grinding in a pulverizer such as ball mill, attritor, sand grinder and the like or a suitable emulsifying apparatus to afford each component (material) having a particle size of several microns or below.

As a support, paper, recycled paper, synthetic paper, film, plastic film, foamed plastic film, nonwoven fabric and the like can be used, and a composite sheet combining these can also be used as a support.

The method of application of a coating liquid is not particularly limited, and the liquid can be applied according to a conventionally used well-known coating technique. For example, an off-machine coater and an on-machine coater provided with various coaters such as air knife coater, rod blade coater, Bill-blade coater, roll coater, curtain coater and the like are appropriately selected and used. While the amount of the thermal recording layer to be formed is not particularly limited, it is generally 2-12 g/m$^2$ in a dry weight.

The thermal recording material of the present invention may further have an overcoating layer on a thermal recording layer to enhance the preservation property, or an undercoating layer of a polymer substance containing a pigment, and the like under a thermal recording layer to enhance the color development sensitivity. Moreover, it is also possible to attempt correction of curl by forming a backcoating layer on the opposite side from the thermal recording layer on the support. In addition, various known techniques in the field of thermal recording materials such as a smoothing treatment (e.g., application of supercalender and the like) after coating of each layer and the like can be appropriately added as necessary.

EXAMPLES

The present invention is explained in detail in the following by referring to Examples, which are not to be construed as limitative. Unless otherwise specified, "parts" means "parts by weight" in each Example.

The composition of the first developer (condensed composition represented by the formula (I)) was determined based on the analysis by high performance liquid chromatography (HPLC) under the following conditions, wherein the rate (area %) of each constituent component relative to the total area of the constituent components as 100 is shown, and other impurities are not included.

column: Inertsil ODS-2
particle size: 5 μm
column: 4.6 mmϕ×5 cm
eluent: acetonitrile:0.05 vol % aqueous phosphoric acid solution=98:2 (vol)
flow rate: 0.8 mL/min
wavelength: 280 nm
injection volume: 1.0 μL
column temperature: 40° C.
analysis time: 25 min
sample concentration: about 2500 ppm

1. First Organic Developer (1) condensed composition comprising 60% of 2,2'-methylenebis(4-t-butylphenol)

[Composition]

2,2'-methylenebis(4-t-butylphenol):2,6-bis(2-hydroxy-5-t-butylbenzyl)-4-t-butylphenol:2,2'-methylenebis[6-[(2-hydroxy-5-t-butylphenyl)methyl]-4-t-butylphenol]:2,6-bis[[2-hydroxy-3-[(2-hydroxy-5-t-butylphenyl)methyl]-5-t-butylphenyl]methyl]-4-t-butylphenol:2,2'-methylenebis[6-[[2-hydroxy-3-[(2-hydroxy-5-t-butylphenyl)methyl]-5-t-butylphenyl]methyl]-4-t-butylphenol]:2,6-bis[[2-hydroxy-3-[2-hydroxy-3-[(2-hydroxy-5-t-butylphenyl)methyl]-5-t-butylphenyl]methyl]-5-t-butylphenyl]methyl]-4-t-butylphenol=63.2:26:8:2.2:0.5:0.1

(2) condensed composition comprising 60% of 2,2'-methylenebis(4-methylphenol)

[Composition]

2,2'-methylenebis(4-methylphenol):2,6-bis(2-hydroxy-5-methylbenzyl)-4-methylphenol:2,2'-methylenebis[6-[(2-hydroxy-5-methylphenyl)methyl]-4-methylphenol]:2,6-bis[[2-hydroxy-3-[(2-hydroxy-5-methylphenyl)methyl]-5-methylphenyl]methyl]-4-methylphenol:2,2'-methylenebis[6-[[2-hydroxy-3-[(2-hydroxy-5-methylphenyl)methyl]-5-methylphenyl]methyl]-4-methylphenol]:2,6-bis[[2-hydroxy-3-[2-hydroxy-3-[[(2-hydroxy-5-methylphenyl)methyl]-5-methylphenyl]methyl]-5-methylphenyl]methyl]-4-methylphenol=56:29:10:3.6:0.9:0.5

2. Thermal Recording Material

Example 1

Dispersion liquids of each material of a dye, a developer and a sensitizer having the following formulation were prepared in advance and subjected to wet grinding in a sand grinder to an average particle size of 0.5 μm.

| | |
|---|---|
| <Developer dispersion liquid A> | |
| Bisphenol A (second developer) | 6.0 parts |
| 10% aqueous polyvinyl alcohol solution | 18.8 parts |
| water | 11.2 parts |
| <Developer dispersion liquid B> | |
| condensed composition containing 60% of 2,2'-methylenebis(4-t-butylphenol) (first developer) | 6.0 parts |
| 10% aqueous polyvinyl alcohol solution | 18.8 parts |
| water | 11.2 parts |
| <Dye dispersion liquid> | |
| 3-di-n-butylamino-6-methyl-7-anilinofluoran (trade name: ODB-2, manufactured by YAMAMOTO CHEMICALS Inc.) | 3.0 parts |
| 10% aqueous polyvinyl alcohol solution | 6.9 parts |
| water | 3.9 parts |
| <Sensitizer dispersion liquid > | |
| diphenylsulfone | 6.0 parts |
| 10% aqueous polyvinyl alcohol solution | 18.8 parts |
| water | 11.2 parts |

A mixed layer coating liquid having the following formulation was prepared and applied to a high-quality paper having a basic weight of 50 g/m$^2$ such that the coating amount after drying was 8 g/m$^2$, and dried. The paper was treated in a supercalender to achieve a Bekk smoothness of 200-600 sec to give a thermal recording material.

| | |
|---|---|
| Developer dispersion liquid A (proportion of the second developer to the total amount of developers: 98%) | 35.3 parts |
| Developer dispersion liquid B (proportion of the first developer to the total amount of developers: 2%) | 0.7 part |
| Dye dispersion liquid | 13.8 parts |
| Sensitizer dispersion liquid | 36.0 parts |
| 25% Amorphous silica (trade name: CARPLEX101, manufactured by Degussa Japan) dispersion liquid | 26.0 parts |
| 50% Calcium carbonate (trade name: Tunex E, manufactured by SHIRAISHI CALCIUM KAISHA, LTD.) dispersion liquid | 13.0 parts |
| 30% Zinc stearate dispersion liquid | 6.7 parts |
| 10% Polyvinyl alcohol | 20 parts |

Example 2

In the same manner as in Example 1 except that developer dispersion liquid A (34.2 parts) (proportion of the second developer to the total amount of developers: 95 wt %) and developer dispersion liquid B (1.8 parts) (proportion of the first developer to the total amount of developers: 5 wt %) were used, a thermal recording material was obtained.

Example 3

In the same manner as in Example 1 except that developer dispersion liquid A (32.4 parts) (proportion of the second developer to the total amount of developers: 90 wt %) and developer dispersion liquid B (3.6 parts) (proportion of the first developer to the total amount of developers: 10 wt %) were used, a thermal recording material was obtained.

Example 4

In the same manner as in Example 1 except that developer dispersion liquid A (28.8 parts) (proportion of the second developer to the total amount of developers: 80 wt %) and developer dispersion liquid B (7.2 parts) (proportion of the first developer to the total amount of developers: 20 wt %) were used, a thermal recording material was obtained.

Example 5

In the same manner as in Example 1 except that developer dispersion liquid B (10.8 parts) was added to developer dispersion liquid A (36 parts) (proportion of the second developer to the total amount of developers: 77 wt %, proportion of the first developer to the total amount of developers: 23 wt %) were used, a thermal recording material was obtained.

Example 6

In the same manner as with the developer dispersion liquid B except that a condensed composition containing 60% of 2,2'-methylenebis(4-methylphenol) was used instead of the condensed composition containing 60% of 2,2'-methylenebis (4-t-butylphenol), developer dispersion liquid C was prepared, and In the same manner as in Example 1 except that the developer dispersion liquid C was used instead of the developer dispersion liquid B, a thermal recording material was obtained.

Example 7

In the same manner as in Example 1 except that bisphenol A in the developer dispersion liquid A was changed to bisphenol S, a thermal recording material was obtained.

Example 8

In the same manner as in Example 2 except that bisphenol A in the developer dispersion liquid A was changed to bisphenol S, a thermal recording material was obtained.

Example 9

In the same manner as in Example 3 except that bisphenol A in the developer dispersion liquid A was changed to bisphenol S, a thermal recording material was obtained.

Example 10

In the same manner as in Example 4 except that bisphenol A in the developer dispersion liquid A was changed to bisphenol S, a thermal recording material was obtained.

Example 11

In the same manner as in Example 1 except that developer dispersion liquid A (21.6 parts) wherein bisphenol A had been changed to bisphenol S (proportion of the second developer to the total amount of developers: 60 wt %) and developer dispersion liquid B (14.4 parts) (proportion of the first developer to the total amount of developers: 40 wt %) were used, a thermal recording material was obtained.

Example 12

In the same manner as in Example 3 except that bisphenol A in the developer dispersion liquid A was changed to 4-hydroxy-4'-n-propoxydiphenylsulfone, a thermal recording material was obtained.

Example 13

In the same manner as in Example 4 except that bisphenol A in the developer dispersion liquid A was changed to 4-hydroxy-4'-n-propoxydiphenylsulfone, a thermal recording material was obtained.

Comparative Example 1

In the same manner as in Example 1 except that developer dispersion liquid B was not used and developer dispersion liquid A (36 parts) was used, a thermal recording material was obtained.

Comparative Example 2

In the same manner as in Comparative Example 1 except that bisphenol A in the developer dispersion liquid A was changed to bisphenol S, a thermal recording material was obtained.

Comparative Example 3

In the same manner as in Comparative Example 1 except that bisphenol A in the developer dispersion liquid A was changed to 4-hydroxy-4'-n-propoxydiphenylsulfone, a thermal recording material was obtained.

The thermal recording materials obtained in the above-mentioned Examples and Comparative Examples were subjected to the following evaluation, the results of which are shown in Table 1.

[Color Development Sensitivity]

Using TH-PMD manufactured by Ohkura Electric Co., Ltd., the prepared thermal recording materials were used for printing at impression energy 0.25 mJ/dot and 0.34 mJ/dot. The image density in the image area after the printing was measured with a Macbeth densitometer (RD-914, using Amber Filter).

[Heat Resistance]

(1) Image Residual Ratio

The thermal recording materials printed using TH-PMD manufactured by Ohkura Electric Co., Ltd. at impression energy 0.34 mJ/dot were left standing under an environment at 60° C. for 24 hr. The image density of the image area was measured by a Macbeth densitometer, and the image residual ratio was calculated by the following formula.

$$\text{Image residual ratio}(\%) = \text{density after test}/\text{density before test} \times 100$$

(2) Non-Image Area

The thermal recording materials were left standing under an environment at 60° C. for 24 hr, and the density of the blank part was measured by a Macbeth densitometer.

[Moisture Resistance]

The thermal recording materials printed using TH-PMD manufactured by Ohkura Electric Co., Ltd. at impression energy 0.34 mJ/dot were left standing under an environment of 40° C., 90% Rh for 24 hr. The image density of the image area was measured by a Macbeth densitometer, and the image residual ratio was calculated by the following formula.

Image residual ratio(%)=density after test/density before test×100

[Water Resistance]

The thermal recording materials printed using TH-PMD manufactured by Ohkura Electric Co., Ltd. at impression energy 0.34 mJ/dot were left standing in water at 23° C. for 24 hr. The image density of the image area was measured by a Macbeth densitometer, and the image residual ratio was calculated by the following formula.

Image residual ratio(%)=density after test/density before test×100

TABLE 1

| | color development | heat resistance | | moisture resistance | water resistance |
|---|---|---|---|---|---|
| | sensitivity 0.25/0.34 mJ/dot | image residual ratio (%) | non-image area | image residual ratio (%) | image residual ratio (%) |
| Ex. 1 | 1.06/1.38 | 81.9 | 0.09 | 96.3 | 58.1 |
| Ex. 2 | 1.14/1.38 | 89.2 | 0.10 | 98.5 | 60.7 |
| Ex. 3 | 1.16/1.42 | 91.5 | 0.11 | 95.7 | 64.5 |
| Ex. 4 | 1.18/1.41 | 94.3 | 0.12 | 96.5 | 67.4 |
| Ex. 5 | 1.14/1.40 | 98.0 | 0.12 | 95.6 | 71.9 |
| Ex. 6 | 1.08/1.38 | 81.5 | 0.10 | 96.0 | 55.7 |
| Ex. 7 | 0.93/1.43 | 62.9 | 0.07 | 75.5 | 59.4 |
| Ex. 8 | 1.09/1.44 | 60.2 | 0.07 | 76.4 | 60.4 |
| Ex. 9 | 1.09/1.43 | 59.3 | 0.08 | 76.2 | 61.5 |
| Ex. 10 | 1.04/1.42 | 59.8 | 0.09 | 81.0 | 64.8 |
| Ex. 11 | 1.04/1.40 | 55.0 | 0.11 | 80.0 | 74.3 |
| Ex. 12 | 1.08/1.38 | 49.3 | 0.07 | 65.2 | 56.5 |
| Ex. 13 | 1.05/1.37 | 64.2 | 0.07 | 78.1 | 64.2 |
| Comp. Ex. 1 | 1.08/1.43 | 57.4 | 0.10 | 95.0 | 43.3 |
| Comp. Ex. 2 | 0.94/1.36 | 50.7 | 0.07 | 71.3 | 55.9 |
| Comp. Ex. 3 | 1.05/1.37 | 27.7 | 0.06 | 65.0 | 52.6 |

As is clear from the results of Table 1, Comparative Example 2 using an antioxidant showed improved preservation property; however, the color development sensitivity decreased. In contrast, it is clear that the thermal recording materials of the Examples (the thermal recording material of the present invention) using a developer (the first developer), which is a condensate or condensed composition represented by the formula (I) and other developer (second developer) such that the developer, which is a condensate or condensed composition represented by the formula (I), (first developer), is contained in a proportion of less than 50 wt % of the total amount of the developers provides a thermal recording material having high color development sensitivity and good preservation property.

Industrial Applicability

The thermal recording material of the present invention can be utilized as an output medium for various measurement equipments, various printers, plotters and the like, and is particularly preferable as an output medium for inspection of electricity, gas, tap water and the like, mobile printer (handy terminal) used for in-house sales (bullet train etc.), custody control in warehouses and the like.

This application is based on a patent application No. 2006-269252 filed in Japan, the contents of which are incorporated in full herein by this reference.

The invention claimed is:

1. A thermal recording material comprising a support and a thermal recording layer comprising a colorless or pale basic leucodye and a developer to develop color of the basic leucodye, wherein the aforementioned developer comprises a first developer which is a condensate or condensed composition represented by the following formula (I) and a second developer other than the first developer, wherein the second developer is at least one kind selected from the group consisting of bisphenol A, 4,4'-dihydroxydiphenylsulfone, 4-hydroxy-4'-n-propoxydiphenylsulfone, 2,4'-dihydroxydiphenylsulfone, 4-hydroxy-4'-allyloxydiphenylsulfone, and bis(3-allyl-4-hydroxyphenyl)sulfone, and the proportion of the first developer to the total amount of the developers is not less than 5 wt % and less than 40 wt %:

(I)

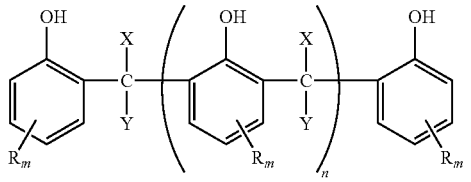

wherein R is a halogen atom, a hydroxyl group, a lower alkyl group, an alkoxyl group, a cyano group, a nitro group, an aryl group or an aralkyl group, R in the number of m may be the same or different, m is an integer of 0 to 3, n is an integer of 0 to 3, and X and Y are each a hydrogen atom, an alkyl group or an aryl group.

2. The thermal recording material of claim 1, wherein the first developer is a condensed composition represented by the formula (I) mainly comprising a condensate of the formula (I) wherein n=0, and further comprising at least one kind of condensate selected from condensates of the formula (I) wherein n is 1-3.

3. The thermal recording material of claim 2, wherein the content of the condensate of the formula (1) wherein n=0 is 40-99%.

4. The thermal recording material of claim 1, wherein the second developer is at least one kind selected from the group consisting of bisphenol A, 4,4'-dihydroxydiphenylsulfone, and 4-hydroxy-4'-n-propoxydiphenylsulfone.

5. The thermal recording material of claim 1, wherein the second developer is bisphenol A.

6. The thermal recording material of claim 1, wherein the proportion of the first developer to the total amount of the developers is not less than 5 wt % and less than 25 wt %.

7. The thermal recording material of claim 1, wherein R in the formula (I) is bonded to the p-position of the hydroxyl group of a phenol group.

8. The thermal recording material of claim 1, wherein thermal recording layer further comprises a sensitizer.

9. The thermal recording material of claim 8, wherein the sensitizer is diphenylsulfone.

* * * * *